US011771243B1

(12) United States Patent
Meyer

(10) Patent No.: US 11,771,243 B1
(45) Date of Patent: Oct. 3, 2023

(54) MATTRESS DISPLAY RACK

(71) Applicant: Metal Dynamics, Ltd., Hillview, KY (US)

(72) Inventor: Daniel J. Meyer, New Albany, IN (US)

(73) Assignee: Metal Dynamics, Ltd., Hillview, KY (US)

( * ) Notice: Subject to any disclaimer, the term of this patent is extended or adjusted under 35 U.S.C. 154(b) by 0 days.

(21) Appl. No.: 17/675,954

(22) Filed: Feb. 18, 2022

Related U.S. Application Data

(60) Provisional application No. 63/163,119, filed on Mar. 19, 2021.

(51) Int. Cl.
*A47F 7/30* (2006.01)
*A47F 5/00* (2006.01)
*B66F 7/00* (2006.01)

(52) U.S. Cl.
CPC ..... *A47F 7/30* (2013.01); *A47F 5/0081* (2013.01); *B66F 7/00* (2013.01)

(58) Field of Classification Search
CPC .. A47F 5/0081; A47F 7/30; B66F 7/00; B66F 7/06; A47B 46/00; A47B 53/00; A47B 61/02; A47C 17/58; A47C 17/56
USPC ..... 211/28, 162, 151; 5/146, 147
See application file for complete search history.

(56) References Cited

U.S. PATENT DOCUMENTS 669,368 A * 3/1901 Melton ..... A47F 7/024 211/28
680,965 A * 8/1901 Distelhurst ..... A47F 7/30 211/126.14
682,004 A * 9/1901 Tucker ..... A47B 53/00 312/308
909,336 A * 1/1909 Reidy ..... A47F 7/30 211/183
1,013,413 A * 1/1912 Marks ..... A47F 7/30 312/328
1,038,865 A 9/1912 Evans
1,071,671 A * 8/1913 McCurdy ..... A47F 7/30 211/28
1,114,455 A * 10/1914 Fisher ..... A47F 7/30 211/126.15
1,257,611 A * 2/1918 Kelly ..... A47F 7/30 211/28
1,625,544 A * 4/1927 Jensen ..... A47F 7/30 211/27
1,626,282 A * 4/1927 Jennings ..... A47F 7/30 211/28
1,894,176 A * 1/1933 Hirsch ..... A47B 43/00 211/198
2,029,407 A * 2/1936 Blumental ..... A47F 7/30 211/28

(Continued)

FOREIGN PATENT DOCUMENTS

CN 205597620 U 9/2016

*Primary Examiner* — Jennifer E. Novosad

(74) *Attorney, Agent, or Firm* — Law Office of J. L. Simunk, PLLC; Joan L Simunk

(57) ABSTRACT

A mattress display unit includes a housing with a plurality of carriages mounted on rollers that are slidable into and out of the housing, and a platform for each carriage adapted to support a bed spring or mattress, wherein the platform further includes gas springs to allow the platform to move from a vertical position to a horizontal position with the application of relatively little external force.

8 Claims, 2 Drawing Sheets

(56) References Cited

U.S. PATENT DOCUMENTS 2,076,848 A * 4/1937 Keiver ..... A47F 7/30 211/28
2,154,622 A * 4/1939 Jones ..... A47F 7/30 211/28
2,174,870 A * 10/1939 Daniels ..... A61G 7/08 211/28
2,175,981 A * 10/1939 Quincey ..... D06G 1/00 211/28
2,253,764 A * 8/1941 Condon ..... A47F 7/30 211/28
2,348,398 A * 5/1944 Lorey ..... A47F 7/30 211/28
2,444,776 A * 7/1948 Kalning ..... B65G 1/07 211/59.3
2,565,027 A * 8/1951 Jensen ..... A47C 17/44 280/30
3,185,306 A * 5/1965 Delaney ..... A47F 7/30 211/28
3,279,617 A * 10/1966 Small ..... A47F 5/135 211/27
3,357,569 A * 12/1967 Goodman ..... A47F 7/30 414/277
3,567,039 A * 3/1971 Evans ..... B65G 1/06 211/13.1
3,912,086 A * 10/1975 de Bruyn ..... A47F 7/0042 16/88
4,036,370 A * 7/1977 Chevalier ..... A47F 7/16 211/162
4,678,085 A * 7/1987 Sando ..... A47F 7/30 211/28
5,375,959 A * 12/1994 Trento ..... B65G 1/18 414/277
5,495,951 A * 3/1996 Biasini ..... B62B 3/10 211/85.6
5,542,805 A * 8/1996 Lisec ..... B65G 49/068 414/280
5,680,942 A * 10/1997 McAllister ..... A47F 5/0093 211/187
6,185,764 B1 * 2/2001 Merritt ..... A47C 17/40 5/164.1
6,220,457 B1 * 4/2001 Resta ..... B65G 1/10 211/28
7,987,997 B2 * 8/2011 Glogovsky, Jr. ..... G09F 7/18 211/28
8,052,120 B2 * 11/2011 Bacon ..... B66F 7/0633 280/32.6
9,044,108 B1 6/2015 Konrath
9,211,016 B2 * 12/2015 Guyvoronskiy ..... A47C 17/48
9,332,866 B1 5/2016 Konrath
9,474,393 B2 * 10/2016 Denby ..... A47B 96/027
9,661,941 B1 * 5/2017 Sawyer ..... A47F 7/30
9,717,349 B1 * 8/2017 Konrath ..... A47F 5/0081
2005/0011845 A1 * 1/2005 Ernst ..... A47F 5/16 211/150
2007/0062899 A1 * 3/2007 Royalty ..... B65D 19/08 211/151
2012/0248046 A1 * 10/2012 Warner ..... A47B 51/00 211/1.57

* cited by examiner

MATTRESS DISPLAY RACK

CROSS-REFERENCE TO PRIOR APPLICATIONS

The present application claims priority to U.S. Ser. No. 63/163,119 filed 19 Mar. 2021, which is incorporated herein in its entirety by reference.

FIELD OF THE INVENTION

The invention relates to display racks for bed springs and mattresses. More specifically, the present invention relates to display racks for bed springs and mattresses for use in retail facilities to allow the retailer to conveniently store the bed springs and/or mattresses and to allow for easy retrieval of a particular bed spring or mattress for customer evaluation.

BACKGROUND OF THE INVENTION

Bed mattresses come in a large array of styles. Mattresses vary by size, firmness, cushioning, construction materials. For example, while the terms "twin", "full", "queen" and "king" generally represent standard lengths and widths for mattresses, the depth of the mattress can vary significantly, from a depth of less than about 6" to a depth of 15" or more. Further, depending on the materials used and the mattress construction, the mattress comfort range may vary from extra firm to ultra plush. Some mattresses include special features, such as including special pressure relief construction, cool to the touch materials, or hypoallergenic materials.

It is generally known that sleep can affect human health and ability to perform during awake hours. It is also generally known that the proper mattress is an important component for getting a good night's sleep. Because of this, it is common for a potential customer of a bed mattress to want to be able to see, feel and even lay upon a sample mattress before purchasing a mattress.

However, a large amount of floor space can be required to display bed mattresses in a position suitable for customer evaluation. To reduce the floor space requirements, mattress storage and display racks are commonly used. These racks allow the retailer to store a plurality of mattresses in a limited amount of space and to easily access a mattress in the rack for display to a customer. An exemplary display rack is taught in U.S. Pat. No. 1,625,544 wherein a mattress is reversibly secured to a metal platform, and the metal platform is further secured to a carriage designed to slide into and out of a housing. The platform is mounted on the carriage so as to be moveable relative to a floor. In a closed position, the platform is essentially perpendicular to the floor so the platform and mattress can be stored in the housing; in an open position, the platform is essentially parallel to the floor so the customer can see and touch the mattress in a bed-like setting.

For durability, the mattress display rack components are commonly made from metal or similar durable materials. The weight of the platform combined with the weight of a mattress mounted to the platform can make it difficult for a salesperson to easily move the platform from the closed storage position to the open display position. This can result in the platform dropping to an open position too quickly which can risk damage to the platform and/or the salesperson, and can require the salesperson to have to hoist the platform back to the closed position after use which can potentially cause muscle strain to the salesperson Thus, it would be beneficial to have a mattress display rack that included a platform design that could allow the salesperson to easily move the platform from a storage position to a display position.

Summary of the Present Invention

The present development is a mattress display rack that comprises a housing with a plurality of retention rails, a plurality of carriages mounted on rollers that are slidable into and out of the housing along the retention rails, and a platform for each carriage adapted to support a bed spring or mattress, wherein the platform further includes gas springs to allow the platform to move from a vertical position to a horizontal position.

DETAILED DESCRIPTION OF THE PRESENT DEVELOPMENT

Figure 1:
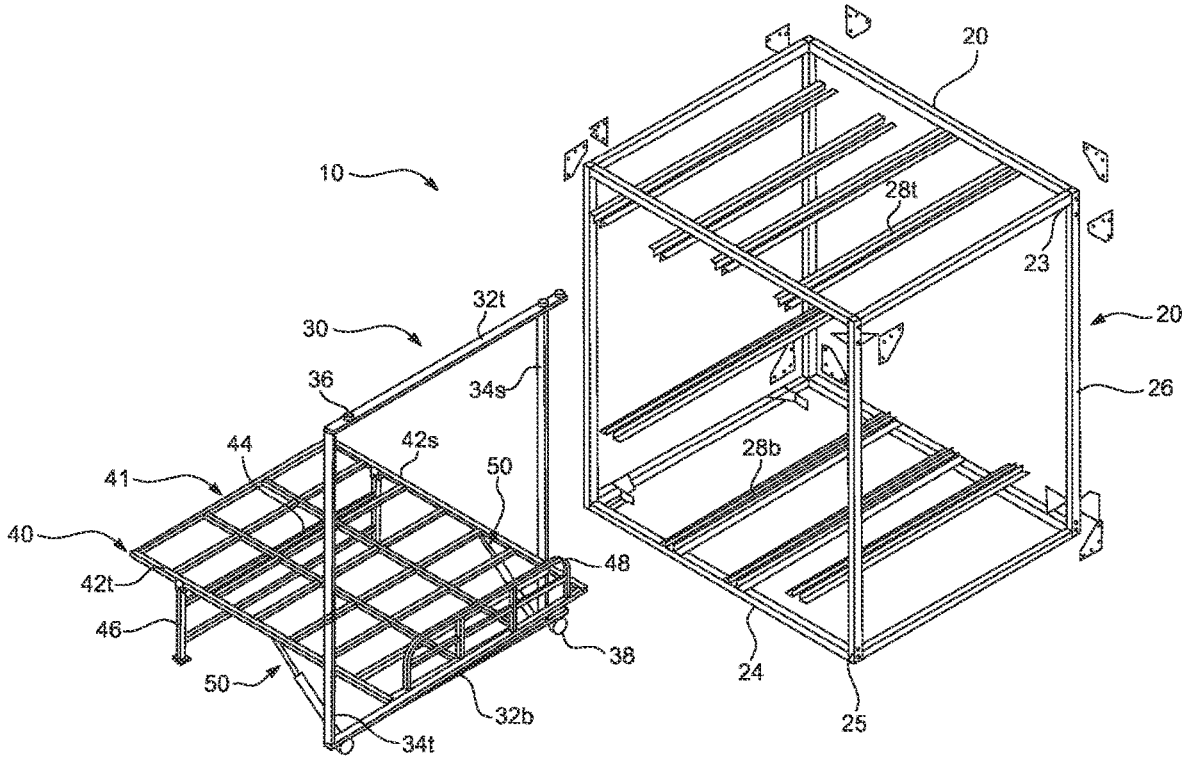
FIG. 1 is a schematic of a mattress display rack made according to the present invention; and, FIG. 2 shows the display rack of FIG. 1 with a mattress positioned on the rack and oriented for a user to examine a mattress.
Figure 2:
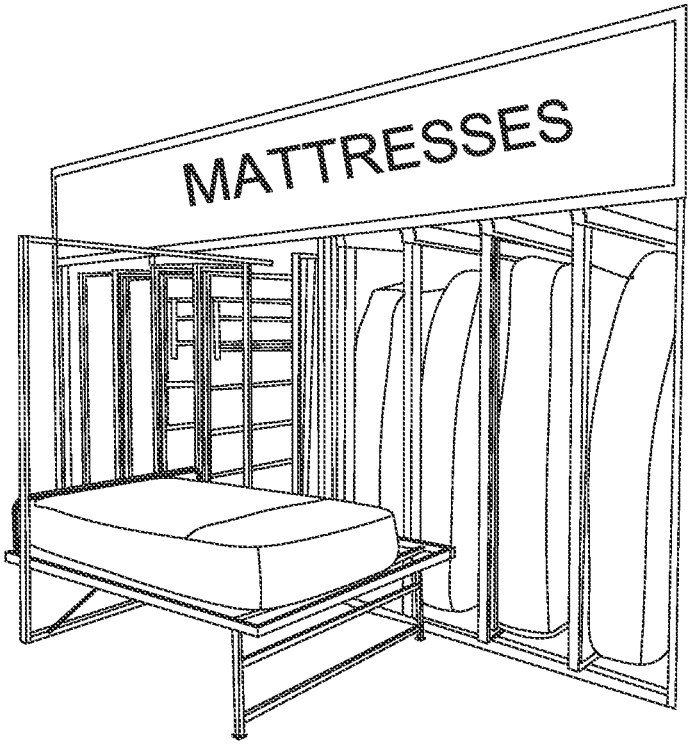

The present development is a mattress display rack 10 as shown in FIGS. 1 and 2. The mattress display rack 10 comprises a housing 20, a plurality of carriages 30, and a platform 40 for each carriage 30 wherein the platform 40 is adapted to support a bed spring or mattress 99 and wherein the platform 40 further includes gas springs 50 to allow the platform 40 to move from a vertical position to a horizontal position.

The housing 20 comprises top frame 22 and a bottom frame 24. In a preferred embodiment, the top frame 22 and bottom frame 24 are essentially equally sized rectangles, the top frame 22 defining four corners 23 and the bottom frame 24 defining four corners 25. The top frame 22 and bottom frame 24 are attached to each other by support arms 26 mounted at each corner. The housing 20 further comprises a plurality of retention rails 28*t*, 28*b*. A set of the retention rails 28*t* are mounted on the top frame 22 and a set of the retention rails 28*b* are mounted on the bottom frame 24. In a preferred embodiment, the bottom frame retention rails 28*b* are positioned directly across from the top frame retentions rails 28*t*. The retention rails 28*t*, 28*b* must be capable of accepting and retaining the carriage 30. The retention rails 28*t*, 28*b* may each be one-piece units or multiple piece units, and the top frame retention rails 28*t* may be similar in design to or may have a different design from the bottom retention rails 28*b*. A variety of designs for the retention rails 28*t*, 28*b* are known in the art.

Each carriage 30 comprises a top support 32*t*, a bottom support 32*b*, at least two vertical supports 34*f*, 34*s*, and at least two top guides 36 and at least two wheels or rollers 38 that are slidable into and out of the housing 20 along the retention rails 28*t*, 28*b*. The top support 32*t*, bottom support 32*b*, and vertical supports 34*f*, 34*s* are positioned to create a frame with the vertical supports affixed to and separating the top support 32*t* and bottom support 32*b*. In a preferred embodiment, a first vertical support 34*f* is attached to a first end of the top support 32*t* and to a first end of the bottom support 32*s*, and a second vertical support 34*s* is attached to the top support 32*t* and the bottom support 32*b* leaving a portion of each support 32*t*, 32*b* extending beyond the second vertical support 34*s*. In a more preferred embodiment, the amount of each support 32*t*, 32*b* extending beyond the second vertical support 34*s* is about 6 inches.

The top guides 36 may be any mechanism that can be retained in and can easily slide along the retention rails 28*t*. In a preferred embodiment, the top guides 36 are wheels mounted parallel to the floor. The top guides 36 are mounted on the top support 32*t* on the side of the support 32*t* opposite the frame interior. The wheels or rollers 38 are mounted on the bottom support 32*b* on the side of the support 32*b* opposite the frame interior. In a preferred embodiment, the rollers 36 are wheels mounted perpendicular to the floor to allow the wheels to rotate when moved across the floor along the retention rails 28*b*.

In a preferred embodiment, at least three top guides 36 are used—one 36*a* positioned close to but slightly removed from the point where the first vertical support 34*f* adjoins the top support 32*t*, one 36*c* positioned at the point where the second vertical support 34*s* adjoins the top support 32*t*, and one 36*b* positioned on the portion of the top support 32*t* that extends beyond the point where the second vertical support 34*s* adjoins the top support 32*t*. In a preferred embodiment, at least two rollers 38 are used—one 38*a* positioned close to the point where the first vertical support 34*f* adjoins the bottom support 32*b* and one 38*b* positioned on the portion of the bottom support 32*b* that extends beyond the point where the second vertical support 34*s* adjoins the bottom support 32*b*. It is recommended, but not required, that during use at least one top guide 36 remains in the top frame retention rail 28*t* and at least one roller 38 remains in the bottom retention rail 28*b*. Optionally, the at least one roller 38 that remains in the bottom retention rail 28*b* may be positioned on the bottom support 32*b* such that when the carriage 30 is extended from the housing 20 at least two top guides 36*b*, 36*c* remain in the top retention rail 28*t*. An exemplary embodiment shown in FIG. 2 has three top guides 36*a*, 36*b*, 36*c*, and two rollers 38*a*, 38*b* (not shown), wherein the roller 38*b* remains within the bottom support 32*b* and two top guides 36*b*, 36*c* remain within the top guide when the carriage 30 is extended from the housing 20.

Each carriage 30 further includes a platform 40 adapted to support a bed spring or mattress 99. The platform 40 comprises a pair of side rails 42*f*, 42*s*, a plurality of cross rails 44, a vertical foot unit 46 and at least two gas springs 50 to allow the platform 40 to move from a vertical orientation to a horizontal orientation. The length of the side rails 42*f*, 42*s* must be shorter than the length of the vertical supports 34*f*, 34*s*, and the length of the cross rails 44 must be shorter than the length of the top support 32*t*. This allows the platform 44 to fit within the carriage frame. The cross rails 44 connect the side rails 42*f*, 42*s* to each other to create a base 41 for the mattress to rest upon. A first cross rail 44*f* connects a first end of the first side rail 42*f* to a first end of the second side rail 42*s*, and a second cross rail 44*s* connects a second end of the first side rail 42*f* to a second end of the second side rail 42*s*. Additional cross rails 44 are inserted parallel to the first cross rail 44*f* and attached the side rails 42*f*, 42*s*. The number of additional cross rails 44 can vary at the discretion of the end user. It is recommended, but not required, that the cross rails 44 be separated by a space of no more than about 18 inches. Optionally, additional rails or attachment bars may be inserted between and parallel to the side rails 42*f*, 42*s* to add support for the display box spring or mattress 99. Optionally, a rest 48 may be attached to the second side rail 42*s* to prevent the mattress from sliding down the platform 40 when the platform is in the vertical orientation.

The vertical foot unit 46 defines a height, $H_L$, and is secured to the base 41 to form legs when the platform is in a horizontal orientation. The foot unit 46 may be a single piece unit or may comprise multiple pieces, but the resulting foot unit 46 must provide a stable support to hold the base 41 essentially parallel to the floor when the mattress is being displayed. In a preferred embodiment, the foot unit 46 is secured to the base 41 with flanges or similar attachment devices to allow the foot unit 46 to fold down and rest against the base 41 when the platform 40 is in a horizontal orientation and to swing to form a 90° angle relative to the base 41 when the platform 40 is in a vertical orientation.

The platform 40 is attached to the carriage 30 by a pair of bolts (not shown). The bolts attach the side rails 42*f*, 42*s* to the vertical supports 34*f*, 34*s*. In order for the base 41 to rest essentially parallel to the floor when in the horizontal orientation, the bolts must be positioned on the vertical supports 34*f*, 34*s* at a distance from the floor essentially equal to $H_L$ and on the side rails 42*f*, 42*s* at a corresponding position when the platform is closed and positioned within the carriage frame. When properly placed, the base 41 should be able to swing from the vertical orientation to a horizontal orientation without scraping or being hindered by the carriage frame.

The platform 40 further comprises at least two gas springs 50. One end of each gas spring 50 is attached to the bottom support 32*b* and the opposing end of the gas spring 50 is attached to the side rails 42*f*, 42*s*. The gas spring 50 selected must have enough force to lift the base 41 and foot unit 46 to a vertical orientation when the mattress 99 is mounted on the base 41, but must not have so much force that the base 41 cannot be opened to a horizontal orientation with little effort. In a preferred embodiment, the gas spring 50 has a nominal non-compressed length of about 18 inches, and a stroke length of about 5 inches to about 10 inches wherein the stroke length is preferably about 8 inches. The weight of the platform 40 combined with the weight of the mattress 99 mounted to the platform 40 can make it difficult for a salesperson to easily move the platform 40 from the closed storage position, or vertical orientation, to the open display position, or horizontal orientation. This can result in the platform 40 dropping to an open position too quickly which can risk damage to the platform and/or the salesperson, and can require the salesperson to have to hoist the platform back to the closed position after use which can potentially cause muscle strain to the salesperson. The gas spring 50 allows the salesperson to easily move the platform 40 from a storage position to a display position.

As is known in the art, the mattress 99 may be secured to the platform 40 using a variety of attachment means. Typical attachments means include straps, belts, leashes, cords, cables, and similar materials.

Although shown herein as a 4-bay unit, as is known in the art, the number of bays may vary without departing from the spirit or scope of the invention. Although shown herein as a left-hand unit, as is known in the art, the housing and carriage may be oriented as a right hand unit without departing from the spirit or scope of the invention.

Unless defined otherwise, all technical and scientific terms used herein have the same meaning as commonly understood by one of ordinary skill in the art to which the presently disclosed subject matter pertains. Representative methods, devices, and materials are described herein, but are not intended to be limiting unless so noted.

The terms "a", "an", and "the" refer to "one or more" when used in the subject specification, including the claims. Unless otherwise indicated, all numbers expressing quantities of components, conditions, and otherwise used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

It is understood that, in light of a reading of the foregoing description, those with ordinary skill in the art will be able to make changes and modifications to the present invention without departing from the spirit or scope of the invention, as defined herein. For example, those skilled in the art may substitute materials supplied by different manufacturers than specified herein without altering the scope of the present invention.

What is claimed is:

1. A mattress display rack comprising:

a. a platform adapted to support a mattress, wherein the platform comprises a first side rail and a second side rail, and wherein the platform can move from a vertical orientation to a horizontal orientation, and wherein at least a first gas spring and a second gas spring are affixed to the platform to facilitate the movement of the platform from the vertical orientation to the horizontal orientation;

b. a carriage adapted to support the platform, wherein the carriage comprises a carriage frame having a top support and a bottom support and at least two vertical supports, at least two rollers and at least two top guides, and wherein the platform fits within the carriage frame; and, c. a housing adapted to accept the carriage by engaging the at least two rollers and at least two top guides when the platform is in the vertical orientation; and, wherein the first gas spring defines a first end affixed to the first side rail of the platform and a second end attached to the bottom support, and wherein the second gas spring defines a first end affixed to the second side rail of the platform and a second end attached to the bottom support.

2. The mattress display rack of claim 1 wherein each gas spring has a nominal non-compressed length of about 18 inches and a stroke length of from about 5 inches to about 10 inches.

3. The mattress display rack of claim 1 wherein the platform has at least one foot unit.

4. The mattress display rack of claim 1 wherein the housing comprises a plurality of retention rails adapted to accept and retain the carriage.

5. A mattress display rack consisting of:

a. a housing comprising a top frame and a bottom frame, wherein the top frame and the bottom frame are separated by support arms, and wherein the housing further comprises a plurality of retention rails mounted on the top frame and on the bottom frame, and wherein the retention rails are adapted to accept and retain at least one carriage;

b. at least one carriage comprising a top support, a bottom support, at least two vertical supports, and at least two top guides and at least two rollers that are slidable along the retention rails, wherein the top support, bottom support, and vertical supports create a carriage frame, and wherein the top guides are mounted on the top support and the rollers are mounted on the bottom support; and, c. a platform for each carriage, wherein the platform fits within the carriage frame and is adapted to support a mattress, and wherein the platform has gas springs affixed to the platform and to the carriage frame such that the platform can move from a vertical orientation to a horizontal orientation.

6. The mattress display rack of claim 5 having at least two gas springs.

7. The mattress display rack of claim 5 wherein the gas springs have sufficient force to lift the platform from a vertical orientation to a horizontal orientation.

8. The mattress display rack of claim 7 wherein the gas springs have a nominal non-compressed length of about 18 inches and a stroke length of from about 5 inches to about 10 inches.

* * * * *